US005864277A

United States Patent [19]

Grimm et al.

[11] Patent Number: 5,864,277

[45] Date of Patent: Jan. 26, 1999

[54] OVERLOAD CURRENT PROTECTION

[75] Inventors: Wilhelm Grimm, Roth; Reinhard Sperlich, Kolbermoor, both of Germany

[73] Assignee: Siemens Matsushita, Comp. GmbH & Co. KG, Munich, Germany

[21] Appl. No.: 741,522

[22] Filed: Oct. 31, 1996

[30] Foreign Application Priority Data

Oct. 31, 1995 [DE] Germany ..... 195 40 604.4

[51] Int. Cl.[6] ..... H01H 85/12

[52] U.S. Cl. ..... 337/297; 337/293

[58] Field of Search ..... 337/227, 228, 337/232, 297, 160, 296, 161, 152, 19, 145, 164, 163, 256, 263, 293, 292, 229; 29/25.42; 361/308, 309

[56] References Cited

U.S. PATENT DOCUMENTS

| | | | |
|---|---|---|---|
| 4,531,268 | 7/1985 | Rayburn | 29/25.42 |
| 4,635,163 | 1/1987 | Voglaire . | |
| 4,706,059 | 11/1987 | Schmitt | 337/297 |
| 4,749,980 | 6/1988 | Morrill, Jr. et al. . | |
| 5,144,523 | 9/1992 | Pageaud | 361/308 |
| 5,166,656 | 11/1992 | Badihi et al. . | |
| 5,479,147 | 12/1995 | Montgomery | 337/297 |

FOREIGN PATENT DOCUMENTS

| | | |
|---|---|---|
| 01 87 921 B1 | 5/1989 | European Pat. Off. . |
| A-0 389 020 | 9/1990 | European Pat. Off. . |
| PS 6 87 672 | 1/1940 | Germany . |
| PS 7 23 291 | 6/1942 | Germany . |
| C-723 291 | 8/1942 | Germany . |
| C-744 200 | 1/1944 | Germany . |
| PS 7 44 200 | 1/1944 | Germany . |
| C-948 894 | 10/1956 | Germany . |
| 25 31 438 C3 | 7/1978 | Germany . |
| 28 39 071 C2 | 9/1979 | Germany . |
| 28 30 963 A1 | 1/1980 | Germany . |
| A-3 530 354 | 3/1987 | Germany . |
| A-275 597 | 5/1951 | Switzerland . |
| 21 63 307 | 2/1986 | United Kingdom . |

OTHER PUBLICATIONS

Raymond A. Higgins, *Applied Physical Metallurgy,* Part I Engineering Metallurgy, 5 Edition S., pp. 536–542.

B.J. Deliduka, et al., *Monolithic Integrated Circuit Fuse Link,* IBM Technical Disclosure Bulletin, vol. 19, No. 4, Sep. 1976, p. 1161.

*Primary Examiner*—Leo P. Picard
*Assistant Examiner*—Anatoly Vortman
*Attorney, Agent, or Firm*—Hill & Simpson

[57] ABSTRACT

An overload current protection arrangement is composed of a thin metallization that is applied onto a carrier foil. The metallization preferably is contacted by schoopage layers. The metallization can be constructed as a layered stack of metallized carrier foils.

20 Claims, 2 Drawing Sheets

OVERLOAD CURRENT PROTECTION

BACKGROUND OF THE INVENTION

The present invention is directed to overload current protection devices.

Fuses are utilized as overload protection, for example in low-voltage networks, household connections, electrical devices or in electronic circuits, and should interrupt the circuit given unacceptably high currents, for example in the case of a short. In the simplest case, these overload current protections are fashioned as cut-out fuses and are then composed of a piece of resistance wire that melts at a specific current load.

Particularly in electronic circuits that are constructed on printed circuit boards, a number of different electrical or, respectively, electronic circuits are utilized that are sensitive to high currents and that could even cause the printed circuit board to catch fire in case of overload due to the dissipated heat that arises.

It is known from the prior art to protect individual electrical components. For example, German patent document DE 25 31 438 C3, incorporated herein by reference, discloses that a tantalum solid electrolyte capacitor can be protected against short-circuit currents caused by incorrect poling by introducing a cut-out fuse between the cathode terminal and contacting.

It is also known, for example from European publication EP 0 187 921 B2, incorporated herein by reference, to provide a cut-out fuse in an electrical capacitor, this cut-out fuse being composed of a coated circuit board wherein the conductive material represents a current fuse.

In a regeneratable electrical capacitor, it is also known to divide the metal coat on the foil into a great plurality of metal areas electrically connected in parallel, each of these being respectively connected to the electrical terminals via a constriction, i.e., a narrowing in width or height, or both, of the current flow path (German Letters Patent 723 291, incorporated herein by reference). Given breakdowns at one of the individual metal areas, it thereby becomes possible that only the constriction lying in front of this area melts through due to the short-circuit current, so that this area is shut off whereas the capacitor continues to be functional.

Given all of the described measures, however, only a single electrical component is disconnected, whereas other components are unprotected. Since it is not economically feasible to provide every component with overload current protection, a traditional overload current protection device that is fashioned as a cut-out fuse is generally integrated in the input circuit given electrical or, respectively, electronic circuits arranged on printed circuit boards.

Since great numbers of these circuits are manufactured for a great variety of applications, the costs of overload current protection becomes a consideration.

SUMMARY OF THE INVENTION

An object of the present invention is to provide a cost-beneficial and economically manufacturable overload current protection.

To that end, in an embodiment the invention provides overload current protection in the form of a thin metallization that is applied on a carrier foil.

In an embodiment, the metallization is preferably contacted by schoop process layers.

These and other features of the invention are discussed in greater detail below in the following detailed description of the presently preferred embodiments with reference to the accompanying drawings.

DETAILED DESCRIPTION OF THE PRESENTLY PREFERRED EMBODIMENTS

Figure 1:
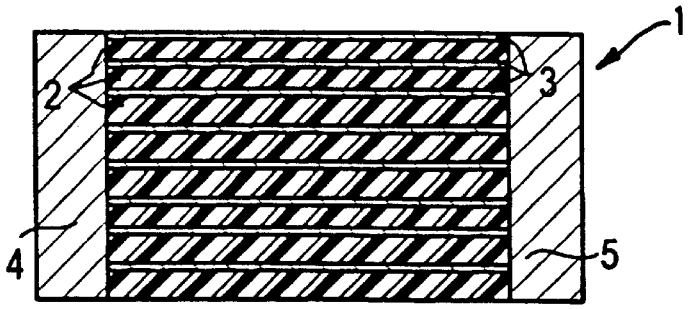
FIG. 1 illustrates a sectional view of an overload current protection in layer structure.

FIG. 1 shows an overload current protection arrangement that comprises layers of carrier foils 2 that are stacked on top of one another and that are provided with one or more metallizations 3. The metallizations 3 are connected between contacts or metal contact layers 4 and 5 that are manufactured according to a schoop or electrostatic spraying method. The illustrated overload current protection is thus composed of many metallizations 3 connected in parallel.

Plastic films (for example, polyester, polycarbonate and polypropylene films) are suitable as the carrier foils 2; paper foils, however, can also be employed. The metallizations are composed, for example, of aluminum and are preferably produced in a thickness that guarantees a surface resistance of 1 through 5 Ω/□. The thickness of the metallizations 3 thereby defines the current-carrying capability of the overload current protection arrangement 1.

The contacts or contact layers 4 and 5 are preferably composed of aluminum. If good solderability is desired, further layers, for example $CuSn_3$ layers, can be arranged on the contact layers.

The overload current protection arrangement 1 can be fashioned as a chip component for soldering on printed circuit boards; however, it can also be provided with leads. If required for the application, the overload current protection arrangement can also be built into a housing. The structural shape also guarantees that desired grid dimensions can be fabricated and that the overload current protections enable an automatic equipping of printed circuit boards.

The overload current protection 1 shown in FIG. 1 can, for example, be manufactured according to a method that is known from the manufacture of film capacitors. A mother winding of metallized carrier foils 2 is thereby wound onto a drum and provided with the contact layers 4 and 5. A separation of the overload current protection subsequently ensues, for example with sawn parting cuts.

Figure 2:
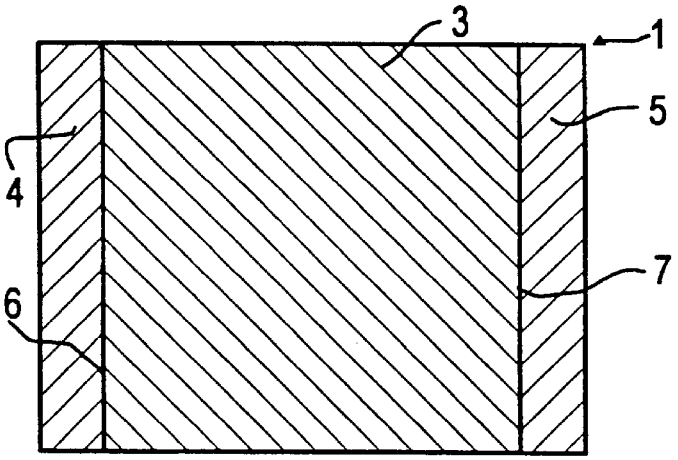
FIG. 2 illustrates a plan view onto the overload current protection of FIG. 1.

FIG. 2 shows the overload current protection of FIG. 1 in a plan view. The schoop contact layers 4 and 5 are porous under the conditions of manufacture. As a result, different contact resistances arise or occur between contact layers 4 and 5 and metallizations 3 at the contact surfaces 6 and 7 that are not as straight as schematically shown in FIG. 2 but instead can comprise a "serrated" structure. Together with the thickness of the metallizations 3, these contact resistances at the contact surfaces 6 and 7 define both the current-carrying capability as well as the trigger behavior of the overload current protection arrangement 1.

Figure 3:
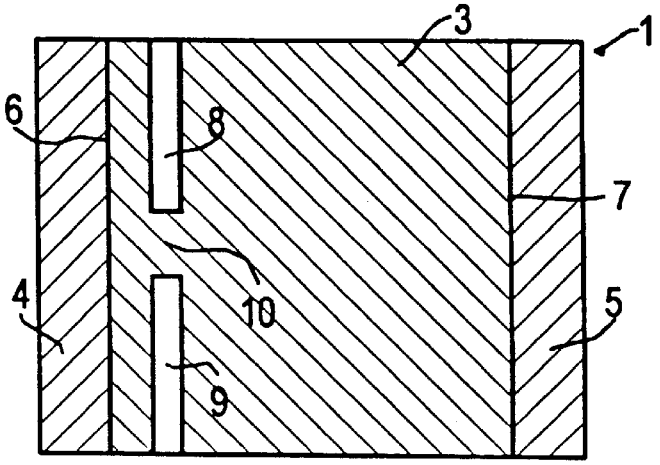
FIG. 3 illustrates a plan view onto a further overload current protection.

FIG. 3 shows a further overload current protection arrangement 1 in plan view, in which the metallizations 3 comprise metal-free stripes or portions 8 and 9 (i.e., areas without a metallic layer) that are arranged parallel to the contact surface 6. The metal-free stripes 8 and 9 are fashioned such that metallized constrictions (narrowings or bridges) 10 are formed, so that the current path between the contact layers 4 and 5 receives an additional fuse point due to the narrowing with whose assistance the overload current behavior of the protection arrangement 1 can be controlled as illustrated in FIG. 3, the constrictions 10 serve as fuse bridges between layer contacts 3*a* and 3*b* of a layer 3.

The constrictions can also comprise configurations other than the constriction 10 shown in FIG. 3. Further, a plurality of constrictions can also be provided as warranted.

In addition to the structure in layer or, respectively, stacked format shown in the drawings, the overload current protection of the invention can also be manufactured in a wound format.

Figure 4:
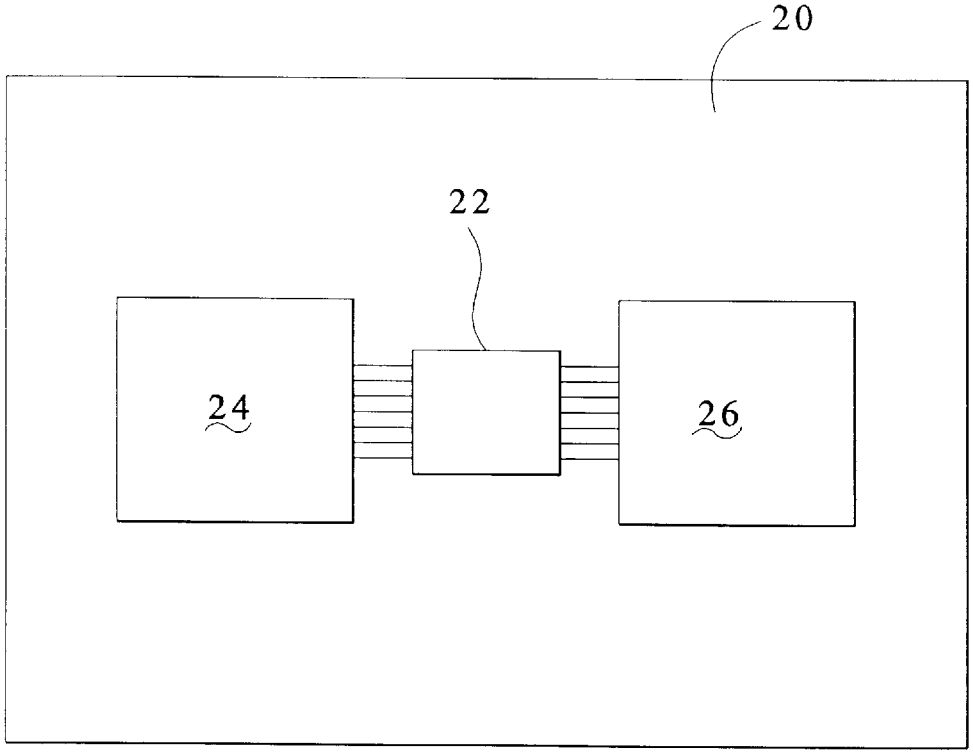
In FIG. 4, there is illustrated in schematic form a printed circuit board 20 carrying a chip 22 comprising an overload current protection device as described above. The device 22 is schematically shown as interconnecting printed circuit portions 24 and 26.

In FIG. 4, there is illustrated in schematic form a printed circuit board 20 carrying a chip 22 comprising an overload current protection device as described above. The device 22 is schematically shown as interconnecting printed circuit portions 24 and 26.

Although modifications and changes may be suggested by those skilled in the art, it is the intention of the inventors to embody within the patent warranted hereon all changes and modifications as reasonably and properly come within the scope of their contribution to the art.

We claim:

1. An overload current protection device comprising one or more thin metallizations applied onto one or more carrier foils to provide a limited current carrying path between two contacts characterized in that each contact comprises a Schoop process layer.

2. The overload current protection device according to claim 1, characterized in that it comprises a layered stack of a plurality of metallized carrier foils.

3. The overload current protection device according to claim 2, characterized in that each metallization comprises aluminum.

4. The overload current protection device according to claim 2, characterized in that each schoop process layer comprises aluminum.

5. The overload current protection device according to claim 2, characterized in that a further, solderable layer is respectively arranged on each schoop process layer.

6. The overload current protection device according to claim 5, characterized in that the further layer comprises $CuSn_3$.

7. The overload current protection device according to claim 1, characterized in that each metallization is formed with a constriction in the current carrying path.

8. The overload current protection device according to claim 1, characterized in that it is fashioned as a chip component.

9. The overload current protection device according to claim 2, characterized in that each carrier foil comprises plastic.

10. An overload current protection device comprising one or more thin metallizations applied onto one or more carrier foils to provide a limited current carrying path between two contacts characterized in that each carrier foil comprises paper.

11. A printed circuit board comprising an overload protection structure comprising one or more thin metallizations applied onto a like number of carrier foils to provide a limited current carrying path between two contacts, wherein the circuit protection structure is further characterized in that each contact comprises a Schoop process layer.

12. The printed circuit board of claim 11, wherein the circuit protection structure is further characterized in that it is formed as a layered stack of a plurality of metallized carrier foils.

13. The printed circuit board of claim 11, wherein the circuit protection structure is further characterized in that each metallization comprises aluminum.

14. A printed circuit board comprising an overload protection structure comprising one or more thin metallizations applied onto a like number of carrier foils to provide a limited current carrying path between two contacts, wherein the circuit protection structure is further characterized in that each metallization has a surface resistance I the range 1 to 5 Ω/□.

15. The printed circuit board of claim 11, wherein the circuit protection structure is further characterized in that each schoop process layer comprises aluminum.

16. The printed circuit board of claim 8, wherein the circuit protection structure is further characterized in that a further, solderable layer is respectively arranged on the schoop process layers.

17. The printed circuit board of claim 16, wherein the circuit protection structure is further characterized in that each further layer comprises $CuSn_3$.

18. The printed circuit board of claim 11, wherein the circuit protection structure is further characterized in that each metallization is formed with constrictions in a current flow path.

19. The printed circuit board of claim 11, wherein the circuit protection structure is formed as a chip component.

20. A printed circuit board comprising an overload protection structure comprising one or more thin metallizations applied onto a like number of carrier foils to provide a limited current carrying path between two contacts, wherein the circuit protection structure is further characterized in that each carrier foil comprises paper.

* * * * *